US006067906A

United States Patent [19]

Ryan et al.

[11] Patent Number: 6,067,906

[45] **Date of Patent: *May 30, 2000**

[54] METHOD AND APPARATUS FOR DISPENSING INK TO A PRINTING PRESS

[75] Inventors: Garth S. Ryan, Alburg, Vt.; Walter J. Stobb, Naples, Fla.

[73] Assignee: Walter Stobb Assoicates, Inc., Naples, Fla.

[ * ] Notice: This patent is subject to a terminal disclaimer.

[21] Appl. No.: 09/135,966

[22] Filed: Aug. 18, 1998

Related U.S. Application Data

[63] Continuation-in-part of application No. 08/871,554, Jun. 10, 1997, Pat. No. 5,878,667.

[51] Int. Cl.[7] ..... B41F 31/08

[52] U.S. Cl. ..... 101/335; 101/366; 101/483; 222/95; 222/386

[58] Field of Search ..... 101/366, 148, 101/483, 350.1; 118/24, 25, 259; 222/95, 105, 386

[56] References Cited

U.S. PATENT DOCUMENTS

| | | | |
|---|---|---|---|
| 2,890,652 | 6/1959 | Jauch et al. | 101/122 |
| 3,199,451 | 8/1965 | Nitchie . | |
| 3,265,254 | 8/1966 | Carter . | |
| 3,417,901 | 12/1968 | Sands . | |
| 3,667,500 | 6/1972 | Stone . | |
| 3,780,651 | 12/1973 | Black . | |
| 3,848,529 | 11/1974 | Gengenheimer . | |
| 4,109,831 | 8/1978 | Culpepper . | |
| 4,155,304 | 5/1979 | Schweisser . | |
| 4,273,043 | 6/1981 | Martino | 101/143 |
| 4,535,693 | 8/1985 | Belverdi . | |
| 4,577,783 | 3/1986 | Racca . | |
| 4,699,054 | 10/1987 | Scrudato . | |
| 5,060,826 | 10/1991 | Coleman . | |
| 5,103,728 | 4/1992 | Barney | 101/364 |
| 5,163,587 | 11/1992 | Apps et al. | 222/105 |
| 5,724,890 | 3/1998 | Deschner et al. | 101/366 |

*Primary Examiner*—John S. Hilten
*Assistant Examiner*—Daniel J. Colilla

[57] ABSTRACT

A method and apparatus for dispensing ink to an ink fountain of a printing press. A flexible bag of ink is utilized and is compressed for forcing the ink into the fountain, and a sensor determines the level of ink in the fountain and thus controls the force on the bag, that is, the compressor on the bag. The flexible bag of ink is subjected to a compressor, which can be a flexible air-filled bladder which forces against the ink bag to compress the ink therefrom and into an ink fountain.

37 Claims, 11 Drawing Sheets

37
46
38
34
39
36
48
41
42
28
47
43
44
37
28
84
77
83
178
86
79
82
81

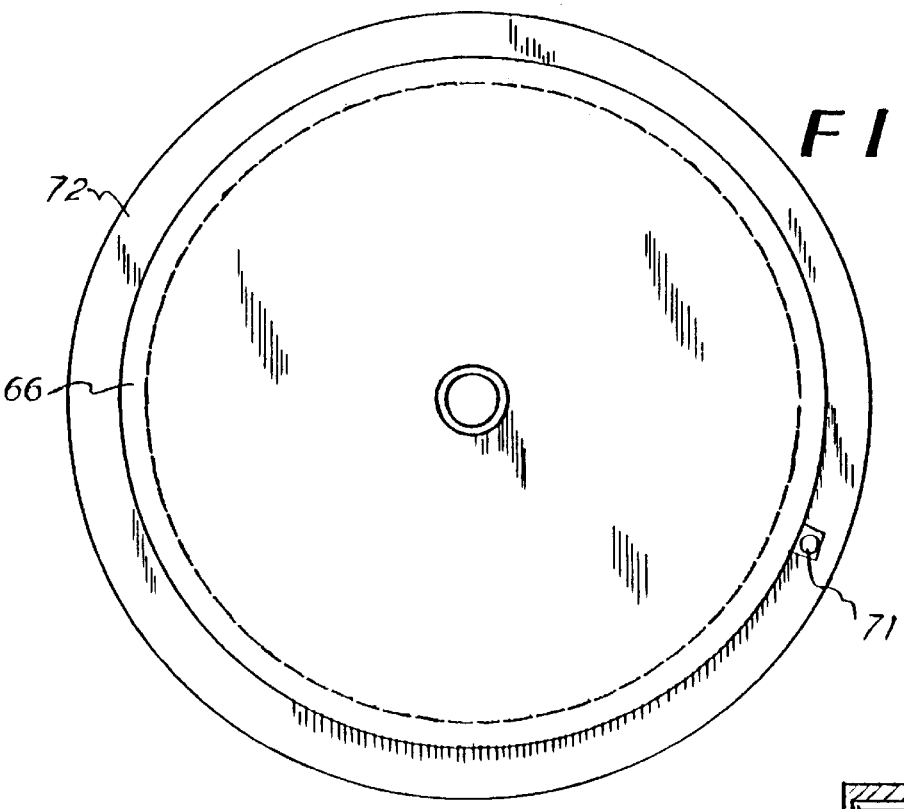
FIG. 5
FIG. 8
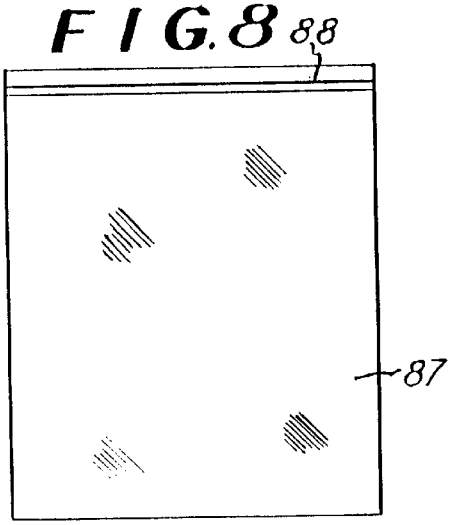
FIG. 9
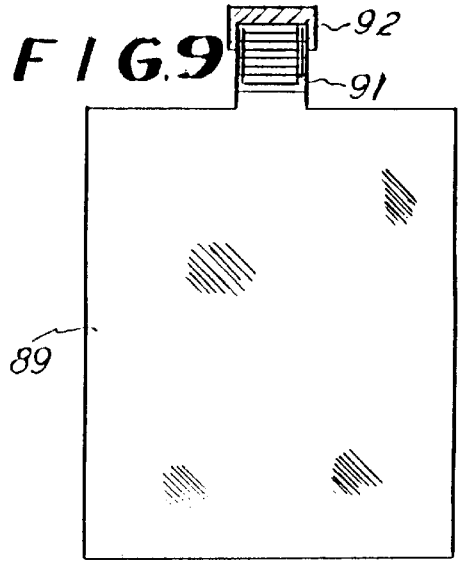

28
22
37
23
16
32
33
31
74
58
76

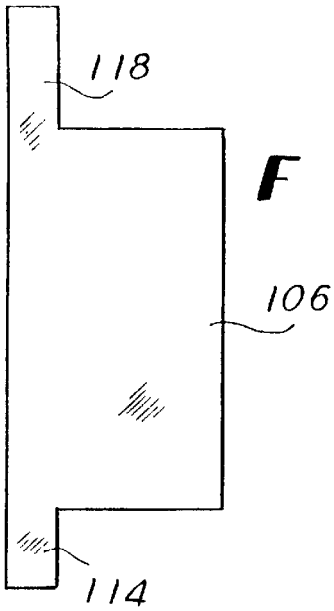
FIG. 16
FIG. 17
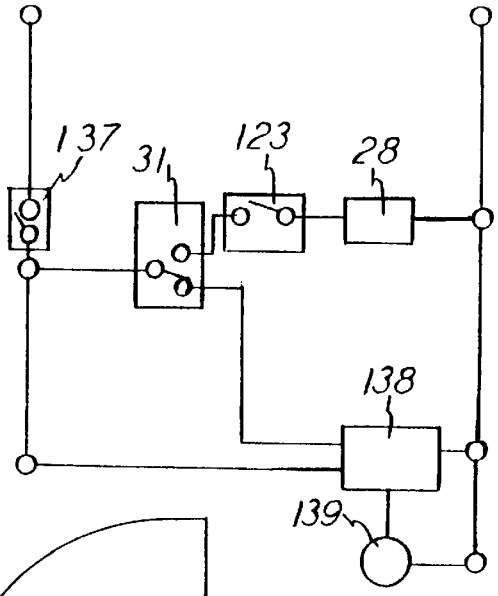
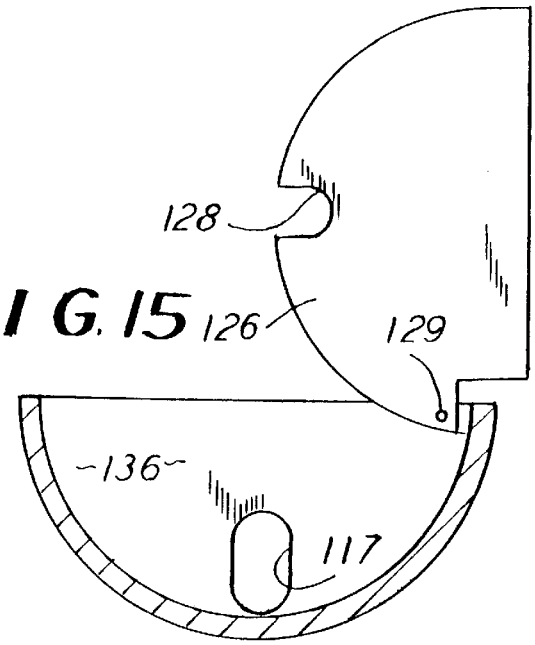
FIG. 15
FIG. 14
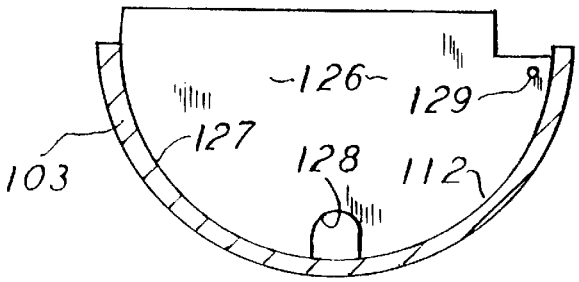

METHOD AND APPARATUS FOR DISPENSING INK TO A PRINTING PRESS

This is a continuation-in-part application of U.S. patent Ser. No. 08/871,554 filed Jun. 10, 1997 now U.S. Pat. No. 5,878,667, issued Mar. 9, 1999 and entitled Method and Apparatus for Dispensing Ink To A Printing Press.

BACKGROUND OF THE INVENTION

This invention relates to both the method and apparatus for dispensing ink to a printing press. More particularly, it relates to the method and apparatus for dispensing ink to a printing press wherein the ink is fully confined to its dispensing location and the printing press ink fountain, and the apparatus is readily cleanable and a variety of different ink colors can be dispensed with intermittent cleaning.

BACKGROUND OF THE INVENTION

In the presently established manners of dispensing printing press ink, the ink may be commonly taken from a rigid container and dispensed into the fountain and this can be done manually. In some of the prior art arrangements, the ink would be supplied to the press fountain manually, and the original ink containers would necessarily be left for the ink therein to dry out and not be usable. This, and other manners, represent the prior art and are found to be time consuming, unclean, wasteful with ink, and requiring constant monitoring by the press operator. In some instances, such as that shown in U.S. Pat. No. 4,699,054, there is the utilization of a bag of ink which feeds, but only by gravity, into a cartridge for the movement of the ink. Printing press ink does not readily respond to gravity flow, and in the aforesaid prior art, the cartridge and its connecting parts were necessarily employed and normally become wasted parts since they cannot be cleaned and reused.

The prior art is also aware of the employment of a sensor in the printing press ink fountain for determining the level of ink in the fountain, and the sensor may be connected to a computer which controls an ink pump for supplying ink to the fountain. Such an arrangement is that which is shown in U.S. Pat. No. 4,854,604. In that arrangement, the ink is dispensed from tanks which are connected to the fountain, and pumps are employed for moving the ink from the tank to the fountain. The arrangement is such that the tanks must be completely emptied after each print run, or the remaining ink in the tank is to be wasted, and the tanks must be specially cleaned, including the connecting lines, before refilling the tank and, of course, before changing the color of the ink.

The present invention improves upon the prior art in that it provides a method and apparatus for dispensing ink to a printing press and doing so in a manner wherein the ink is initially contained in a flexible dispensing bag and is directed to the press fountain in a simplified, automated, and reliable arrangement. More specifically, the ink is dispensed by means of sensing the level of ink in the fountain and correspondingly activating a dispenser which causes the ink to flow from the flexible bag and into the fountain. As such, there is no requirement for pumps, valves, and also no requirement for manual operations and attendance because the entire arrangement is automated, and uses only a solenoid valve.

The present invention also includes a provision and utilization of a flexible ink-containing bag which renders the entire arrangement self-contained and thus clean with regard to the handling of the ink. Other parts of the system are also arranged for easy cleaning and thus expediting the maintaining of the equipment in clean condition and the changing of the operation to different colors of ink.

Still further, the present invention provide for the handling of printing press ink in a manner wherein the operation can be interrupted at any time and the quantity of ink yet to be dispensed, such as that in the flexible bag, can be readily preserved, including the removal of the bag from the remainder of the apparatus. Also, the present arrangement is such that bags of varying sizes can be accommodated. Also, the bags can be completely evacuated in only the normal course of operation.

Another specific object is the arrangement of the dispensing system wherein the system transporting the ink can be readily cleaned at the appropriate time, and such convenience is established by having the components of the system easily disassembled for the cleaning.

Additionally, an object is to provide a flexible bag supplying the ink, and to arrange that the bag is evacuated of its ink directly into the ink fountain, that is, without the need for any interconnecting parts or method steps between the bag and the fountain.

Further, there is the provision of the parts and method steps whereby an ink dispenser manifold is disposed directly above the fountain and distributes ink evenly into the fountain, and it utilizes a distribution nozzle outlet which restricts the ink flow to impart shear to the ink to improve flow by breaking the Thixotropic nature of printing ink. The Thixotropic nature of ink causes it to resist flow if it is stationary for a while, so it is preferred to pressurize it to initiate the flow, otherwise it has a very high viscosity.

Also, the arrangement is such that there is a direct indication of the quantity of the ink in the bag, at any point in the operation. Further, when no further ink is to be moved through the system, then there can be an evacuation of the remaining ink and thereby preliminarily clean or evacuate the ink from the system simply by utilizing the system in its normal arrangement. In the embodiments of this invention, a flexible bag of printing ink is disposed in ink-flow communication with a printing press. In one embodiment, the flexible bag is compressed by means of a flexible bladder which is supplied with air under pressure to press against the flexible ink bag for dispensing the ink through a spout in the ink bag. In dealing with printing ink, the ink is at a viscosity range of one hundred-fifty to two hundred pois (Laray) with a tack range of nineteen to nineteen and one-half at 1200 rpm (inkometer), as in the present invention.

BRIEF DESCRIPTION OF THE DRAWINGS

FIG. 5 is an elevational view of another embodiment of the container part, partly in section, FIGS. 8 and 9 are view of two different arrangements of the flexible bag useful in this invention, FIG. 14 is an enlarged sectional view taken along the line 14—14 of FIG. 10, FIG. 15 is a view of FIG. 14 with a part in a different position, FIG. 16 is a view of the ink bag, FIG. 17 is an electric schematic of the system.

DETAILED DESCRIPTIONS OF THE PREFERRED EMBODIMENTS AND METHOD

The description and drawings with regard to the apparatus is also a disclosure of the method and it should be understood as such.

Figure 1:
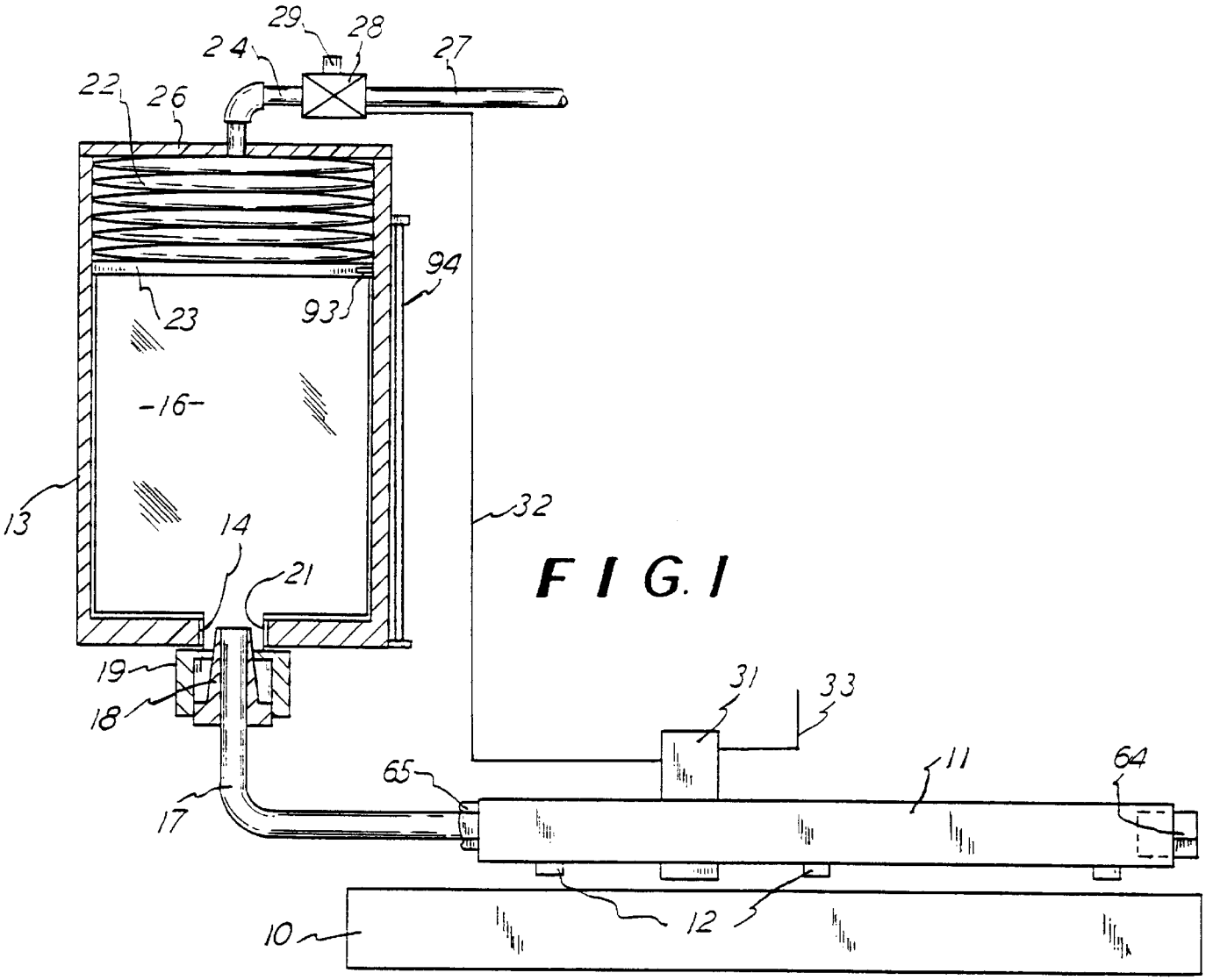
FIG. 1 is an elevational view of one embodiment of this invention, partly in section.

FIG. 1 shows an embodiment with an ink fountain 10 which can be of a standard nature and which supplies the ink to a printing press which is also of a standard nature, but is not shown herein and these parts will be understood to anyone skilled in the art. A manifold 11 is suitably mounted directly above the fountain 10 and has nozzles 12 which are directed downwardly and can direct the flow of ink from the manifold 11 and into the fountain 10. In some arrangements, the actual nozzles 12 can be omitted and a simple formed or tapered type of outlet can exist on the manifold 11, as shown in other drawings.

A rigid container 13 has a lower opening 14 and supports a bag 16 containing the supply of ink, and that bag may be of varying size while the container 13 is of one size. A pipe 17 is suitably connected to the manifold 11 and to the container 13 so that the ink from the bag 16 can be directed into the manifold 11. For that connection, there can be a tapered connector 18 and a threaded nut 19 which mounts on the container and the tapered nut seals with the nut 19, and the lower end of the bag 16 has a mouth and opening 21 which is extended into the container opening 14 and is sealed therewith by the connectors 18 and 19 which can be of a conventional type of threaded nut quick-connect and disconnect.

To apply pressure to the bag 16, FIG. 1 shows an air bellows 22 contained in the upper end of the container 13, and there is a piston 23 therebelow. An air connector 24 connects through the tank top 26 and to the bellows 22 and thus can apply air pressure into the bellows 22 to expand the bellows and press the piston 23 downwardly into the bag 16 to evacuate the bag and cause the ink therein to flow out of the container 13 and into the pipe or passageway 17 and into the manifold 11 and eventually into the fountain 10.

The compressed air enters the pipe 24 and thus the bellows 22 from a pipe 27 and through a solenoid valve 28, the supply of air for the pipe 27 is standard in a printing plant, and is thus available for conducting compressed air into the pipe 27 and to the solenoid 28. A room air relief port 29 is on the solenoid 28.

The solenoid 28 can be normally open, and it connects to an ink level sensor 31 optative on the fountain 10 to determine the level of ink in the fountain. A wire connection 32 extends from the sensor 31 to the solenoid 28 to activate the solenoid 28 according to the demands of the sensor 31 and thus cause the bellows 22 to exert pressure on the bag 16 for the dispensing of ink into the fountain 10. An electric power supply line 33 is shown connected to the sensor 31. Also, the bellows 16 can be a spring return type so that when the air pressure is relieved, the spring will cause the return action, as is well known.

Figures 2, 7:
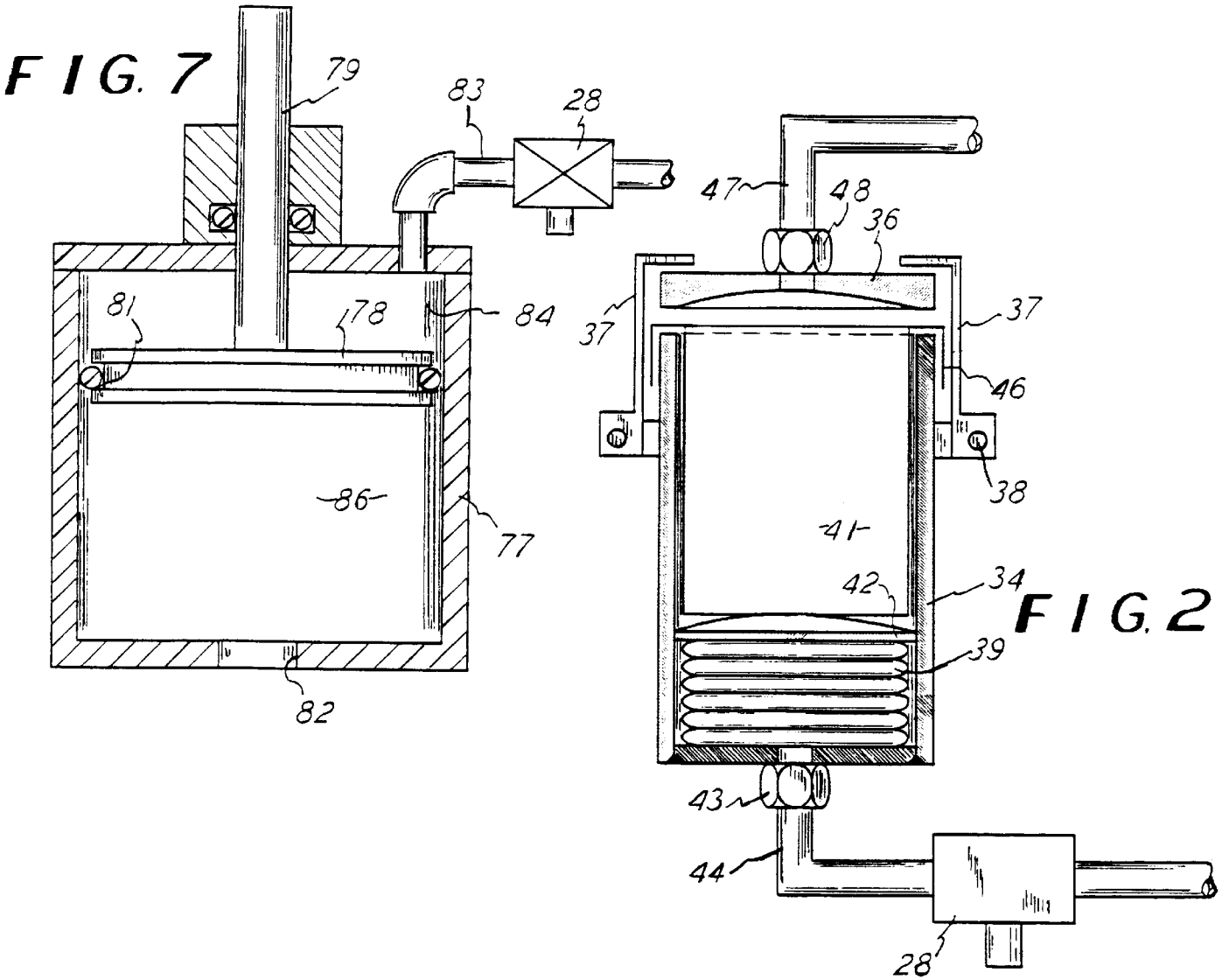
FIG. 2 is an elevational view of another embodiment of this invention, partly in section.
FIG. 7 is a sectional view of another embodiment of this invention.

FIG. 2 shows a somewhat different embodiment, and here it will be seen that there is a container 34 which has a lid 36 held tightly thereon by means of latches 37 hinged to the container 34 at hinges 38. In this instance, there is a bellows which is bellows 39 and it is below the ink bag 41 and thus presses upwardly on the bag 41 through the piston 42. In that embodiment, the solenoid 28 is below, and there is a ready release, but standard type of pipe, connecting nut 43 on the air inlet line 44 for pressurizing the bellows 39 as desired according to the sensor 31 in the fountain 10. The upper portion of the bag 41 has its upper end 46 open and draped over an upper edge of the container 34, and the cover 36 bears downwardly thereon to make it airtight with respect to the container 34, and thus the ink is forced upwardly and out the outlet 47 which is suitably, but quickly detachable from the tank lid 36 by means of the nut 48, and the pipe 47 leads off to the manifold, such as the manifold 11.

Figure 3:
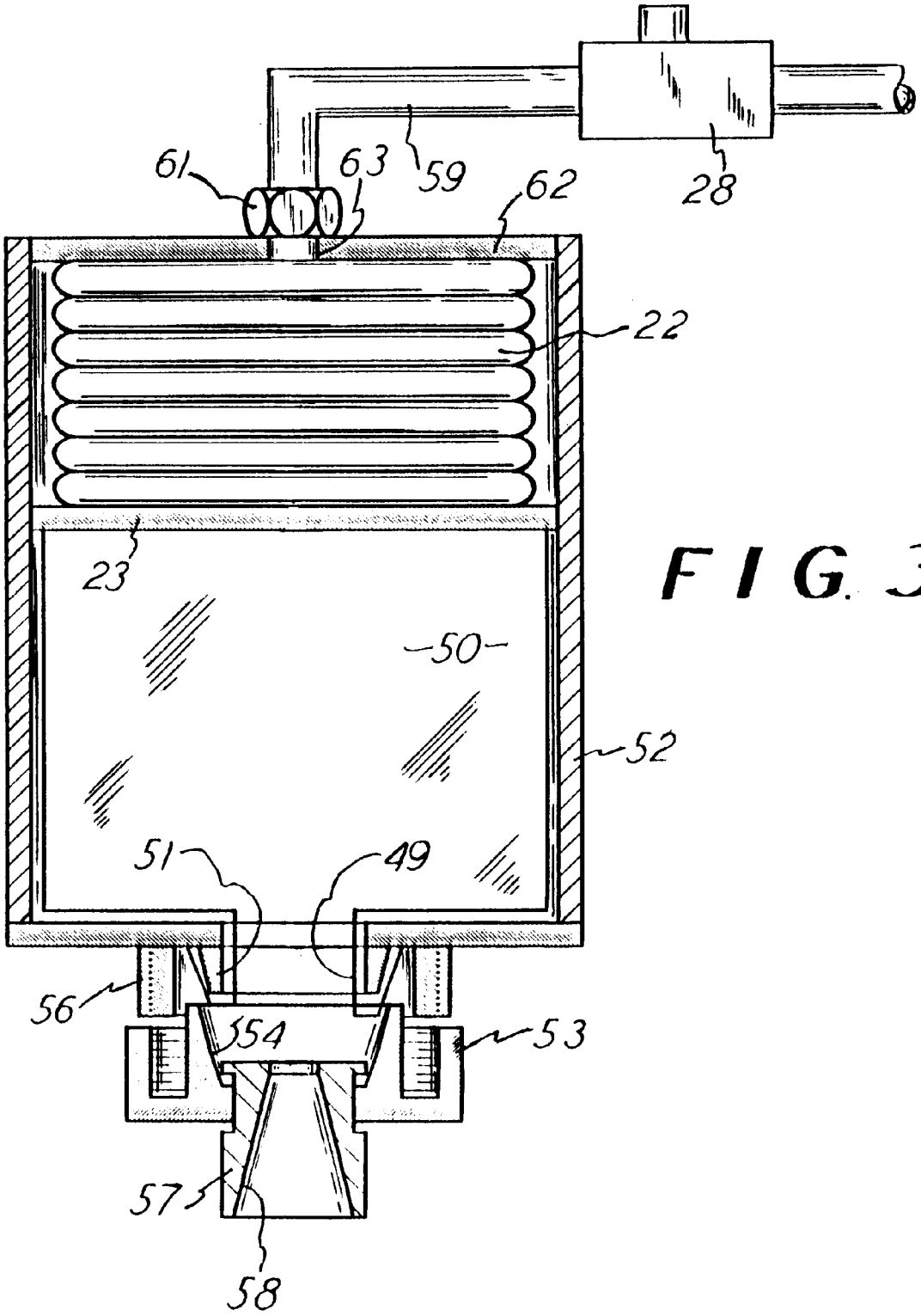
FIG. 3 is an elevational view of another embodiment of the invention, partly in section.

FIG. 3 also shows an embodiment which is akin to FIG. 1 in that the bellows 22 is above the ink bag now designated 50, and the bag 50 has its lower mouth or opening 49 draped over a conical extension 51 on the container 52. A threaded nut 53 fits up against the outer taper of the extension 51 and it too has a taper 54 for engaging the bag mouth 49 and pressing it against the container extension 51 for airtight seal therewith. Of course, the nut 53 threads onto a cylindrically-threaded extension 56 on the container 52. A nozzle 57 is trapped with the nut 53 and has the outwardly conically-flared outlet opening 58 for the passage of the printing ink therethrough and thus the accommodation of the Thixotropic nature of the ink. FIG. 3 also shows the air inlet pipe 59 and the quick-disconnect nut 61 connecting the pipe 59 to the container top 62 and it aligns with the container top inlet opening 63.

FIG. 1 shows that in these arrangements the manifold 11 can be provided with an end-threaded plug 64 and a quick-connect nut 65, both of which can be readily removed for cleaning purposes.

Also, due to the high viscosity of the printing ink, the bags 16 and 50 can be inverted without ink moving therefrom and arranging them for the quick-disconnect nut shown in FIGS. 1 and 3.

Figure 4:
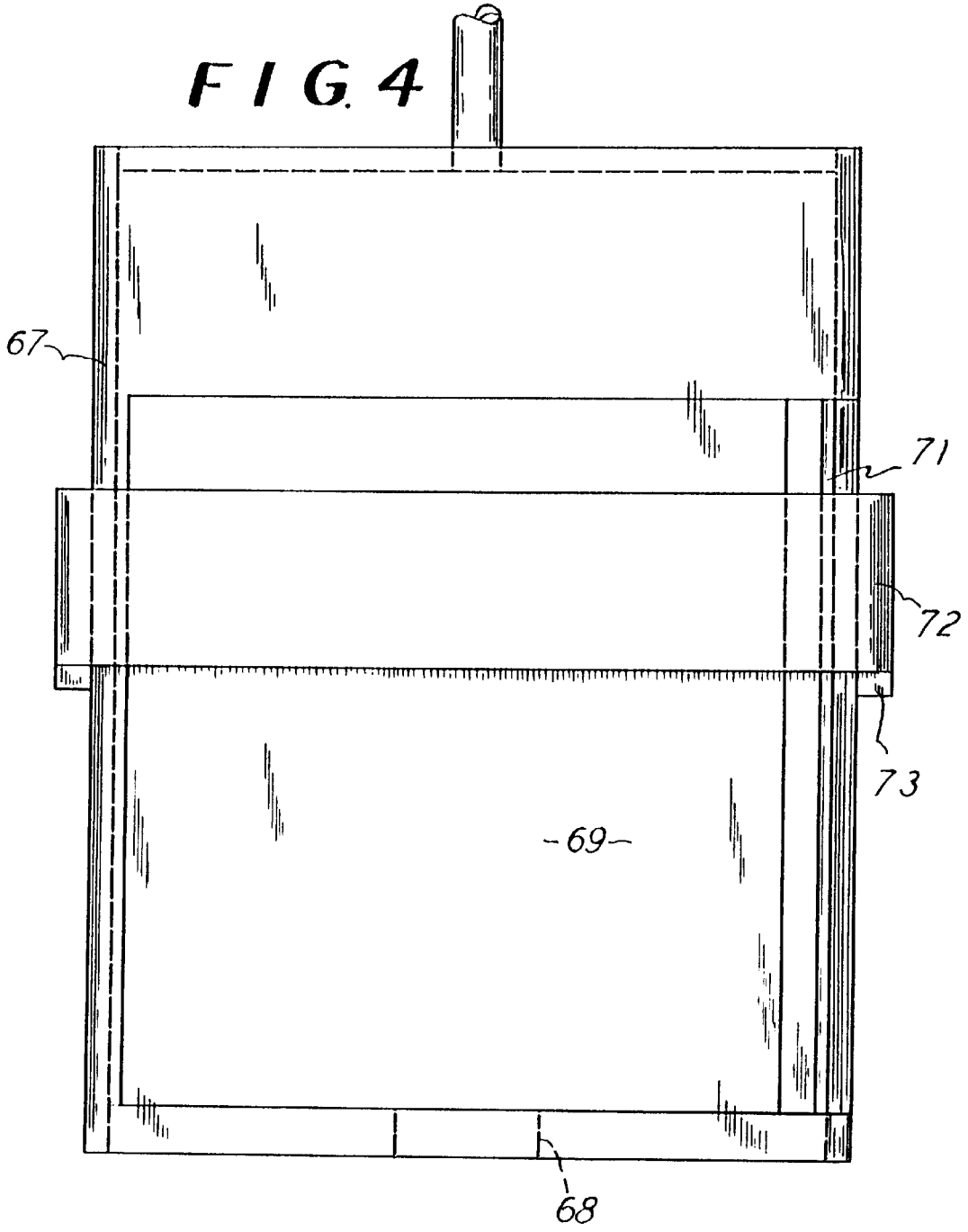
FIG. 4 is an enlarged top plan view of the container part shown in the previous figures.

FIG. 4 shows a container 67 which is cylindrical and which has a lower opening 68 for the outlet connections mentioned. Also, it has a side opening door 69 which permits interior access into the cylindrical container 67 for insertion and removal of an ink bag. There can be a standard door hinge 71 for opening and closing the door 69, and a complete ring 72 extends around the container 67 for holding the door 69 tight with the remainder of the container 67. The ring 72 can slide to the top of the container 67, and ring supports or stops 73 on the container 67 will position the ring 72 in the door-secured position shown.

FIG. 5 shows the top view of the type of container of FIG. 4, and it is preferred that all of the containers shown herein are of a cylindrical shape.

Figure 6:
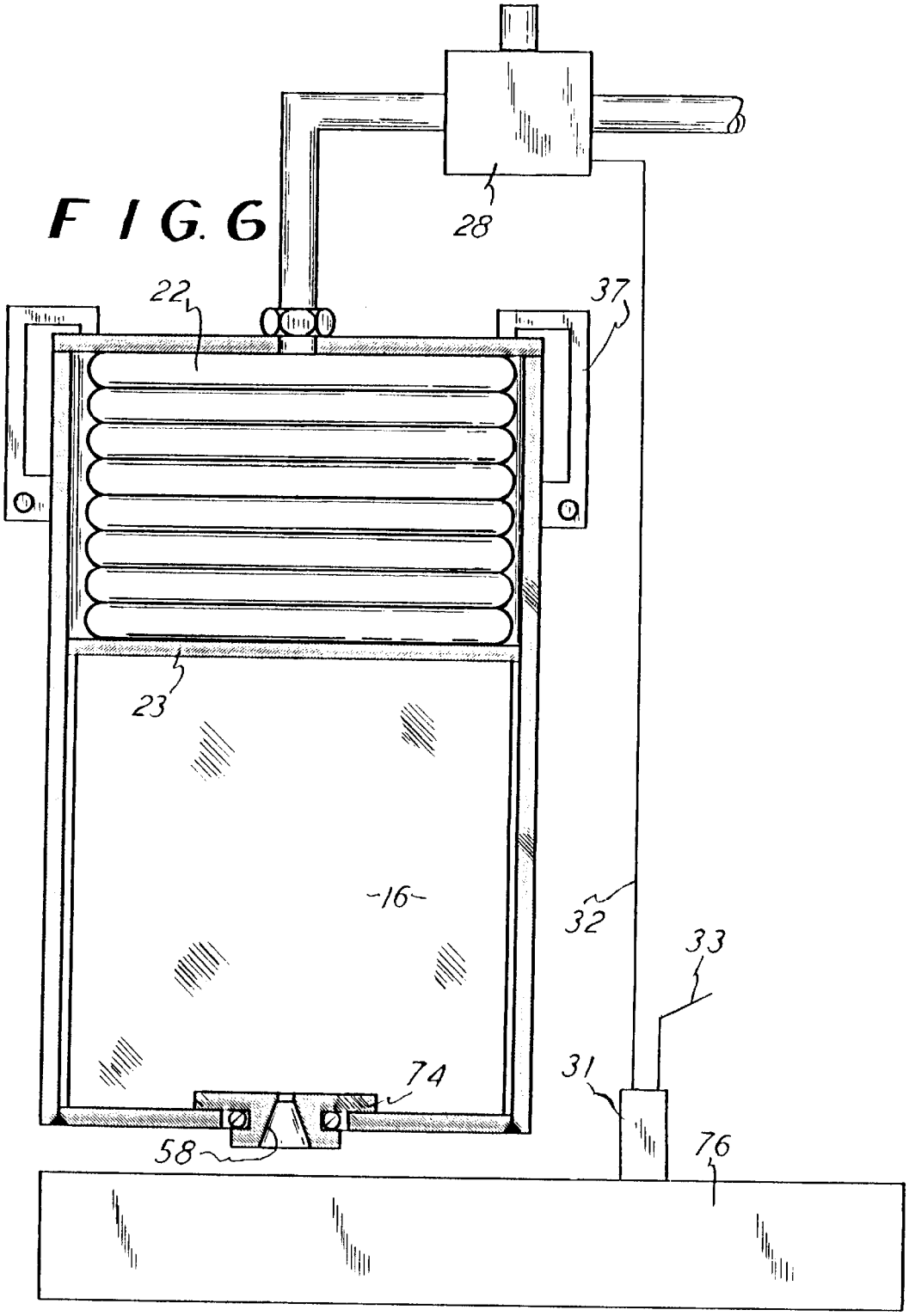
FIG. 6 is an elevational view of another embodiment of this invention.

FIG. 6 shows an arrangement similar to FIG. 3, and in both instances the nozzle 57 and FIG. 6's nozzle 74 have their conically-shaped outlet and, as seen in FIG. 6, the fountain designated 76 is directly below the nozzles 57 and 74, and thus there is no need for the connector such as the pipe 17 and the manifold 11 seen in FIG. 1. Of course there would still be the sensor 31 in the fountain 76 and it would be connected to the solenoid 28.

FIG. 7 shows a different embodiment for providing the compressor or the pressure applicator for the ink bag which would be in the container 77. In that instance, there is a piston 78 and a piton guide rod 79, and an O-ring 81 extends around the piston 78 and engages the inner circular wall of the container 77. The bag would of course exhaust through the container outlet 82 in any manner such as that shown in the other drawings. The air pipe 83 connects directly to the upper chamber 84 of the container 77 to force downwardly on the piston 78 and thus onto the bag which would be in the lower chamber 86, and that would of course replace the bellows in the heretofore shown embodiments.

FIG. 8 shows an ink bag 87 which has a tongue-and-groove type of seam or sealer 88 of a conventional nature so that the bag can be sealed before and after it has been used, assuming that there is remaining ink in the bag, and it is to be preserved without excessive air in the bag.

Also, FIG. 9 shows a bag 89 which has a threaded neck 91 and a cap 92 threaded thereon so that the bag can be opened for removal of the ink and it can be closed for preserving the ink, as desired. In all instances, the bag shown herein are flexible bags and of course are sufficiently sturdy to contain the ink and cause it to flow outwardly through the bag openings as described herein.

FIG. 1 also shows that there are means and method for detecting the level of ink in the bag and that is accomplished by detecting the level of the piston, such as 23 in FIG. 1. The piston 23 has a magnet 93 embedded therein, and there is a magnetically responsive level sensor bar 94 mounted upright along the side of the container 13 and thus it detects the elevation of the magnet 93 and thereby shows the position of the piston 23 and thus the quantity of ink in the bag 16. The aforementioned inherently discloses the method which is that of confining the ink in a flexible bag and disposing it in the rigid container and then applying pressure to the bag to force ink out the outlet and directing that ink-flow to the fountain, whether it be direct to the fountain or to the manifold above the fountain, and there is also the sensing of the level of the ink in the fountain and the sensor connection to regulate the pressure on the bag according to the level sensing. Of course the method also includes the removal of the initial bag of ink and cleaning of the apparatus and then the insertion of another bag and repeating the process with the fresh bag of ink which may be of a color different from the initial bag of ink.

The flexible bag is of a pliable, plastic material which is fully collapsible upon itself to evacuate it of its ink. There may be a mouth or outlet in the bag before it is installed in the rigid container and the mouth outlet is a spout and an outlet section, with a passageway such as seen in FIGS. 1, 2, 3 and 9. The container in FIG. 7 is air tight and of a rigid construction to withstand the necessary pressure applied for evacuating the bag and it has a plurality of walls or sides which define an enclosure where the bag is located. Also, the ring 12 is used to avoid the use of door latches which can be weak.

Figure 10:
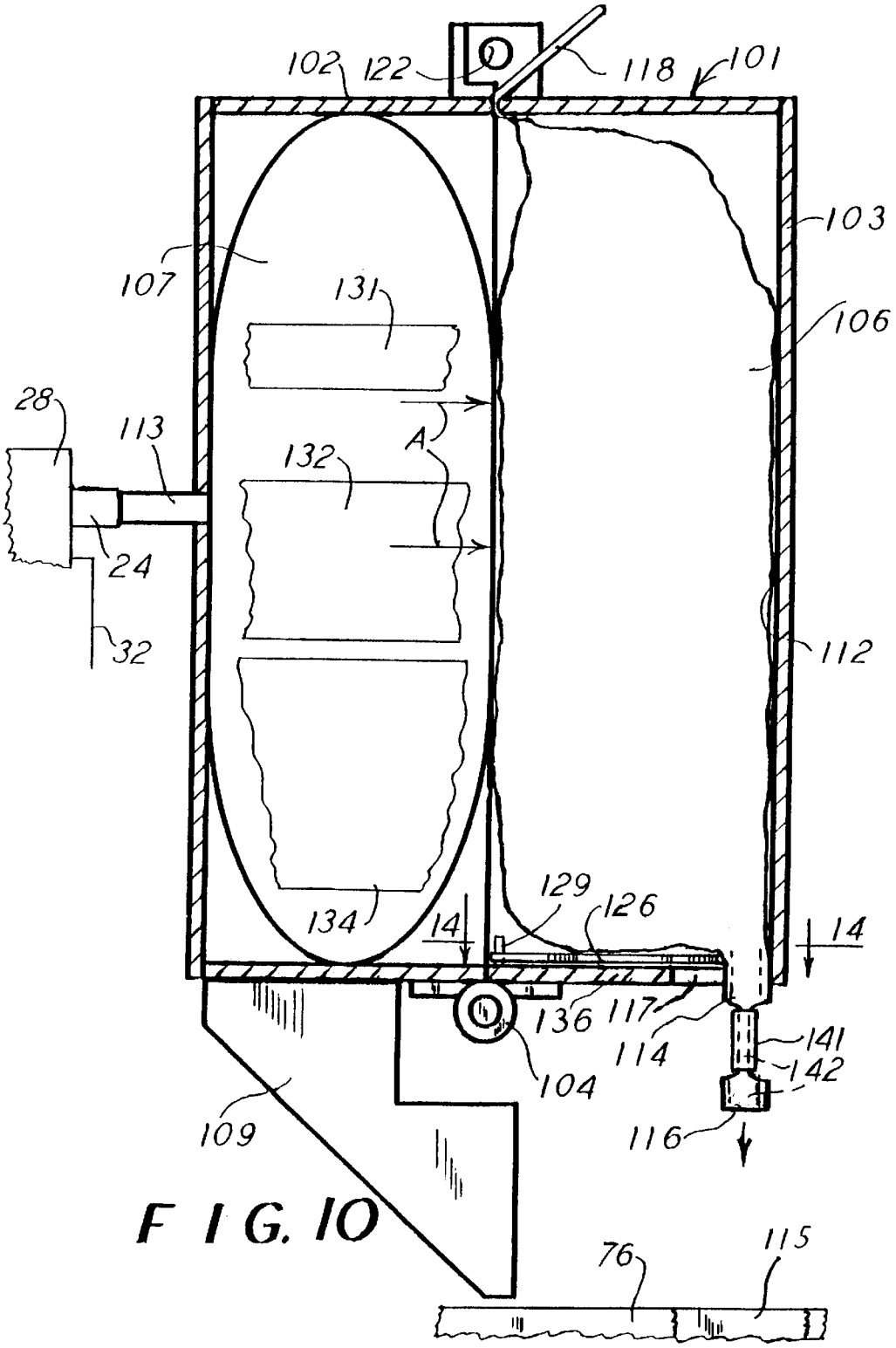
FIG. 10 is a sectional view taken on a vertical plane of another embodiment of this invention.

FIGS. 10 through 16 show another embodiment of this invention, and there is a container or canister generally designated 101, and it is shown in two halves 102 and 103. The halves 102 and 103 are hingedly or pivotally connected together by means of the hinge 104 which connects between the two halves and which is arranged to permit the halves to move from the FIG. 10 position to the FIG. 11 position. The two halves are shown to be semi-circular and elongated in their height, and, together, they provide a one cylindrical container for combining an ink bag 106 and an air bladder 107, as seen in FIG. 10. Thus, the ink bag 106 is a bag of a flexible material so that it can be readily compressed and it is sufficiently sturdy to retain printing ink therein. Also, the bag 106 is shown vertically elongated, and it is shown to occupy essentially the entire half 103 of the container 101. Likewise, the air bladder 107 occupies substantially the entire volume of the half 102 of the container 101.

Figure 11:
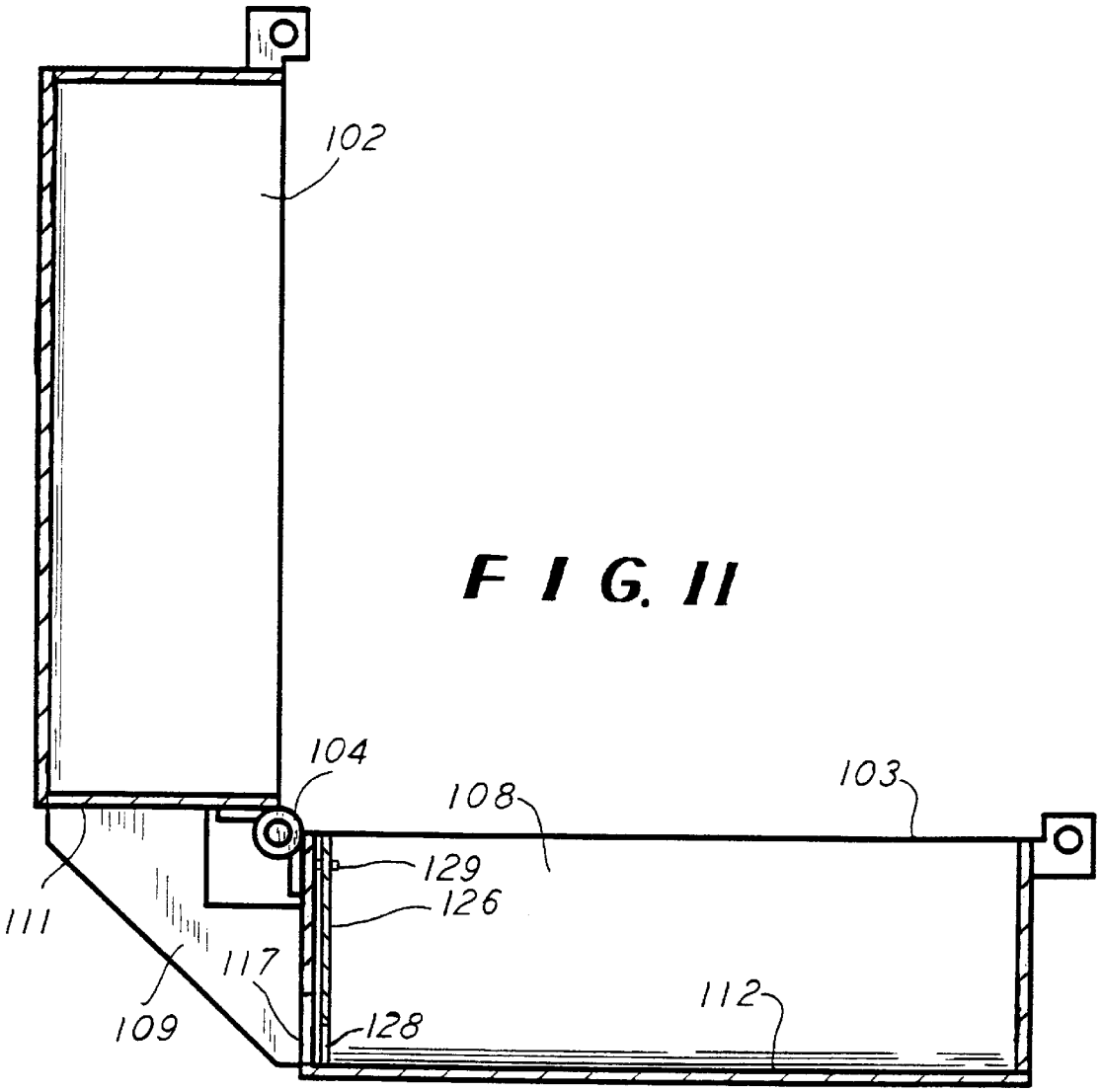
FIG. 11 is a sectional view of FIG. 10, on a slightly reduced scale and with parts omitted.

Thus, the half 103 is arranged to pivot downwardly from the FIG. 10 position to the FIG. 11 position where it presents an upwardly open container half 103 with what is then an open top designated at 108. As such, the ink bag 106 can be laid into the half 103, and it would be understood that the half 102 is preferably in a fixed position so that it does not move and adequately supports the half 103, such as by means of the abutments 109 which are suitably affixed to the bottom 111 of the half 102. That is, the half 103 can be swung in a 90 degree path from the operative enclosed position of FIG. 10 to the ink bag loading position of FIG. 11. Also, the half 103 presents an abutment or wall 112 against which the ink bag 106 is forced, such as by means of the air bladder 107. That is, when the bladder 107 is supplied interiorly with air, such as through the inlet connection 113 integral with the bladder 107, the bladder 107, being in direct contact with the bag 106, will expand and press directly against the ink bag 106, such as seen in FIG. 10 and indicated as by the arrows designated A. The bag 106 has an elongated spout 114 integral with the bag 106 for the flow of printing ink from the bag and through the spout 114 which can have its outlet end 116 initially sealed against the flow of ink and then cut so that the ink can flow downwardly through the spout 114 and into the ink fountain as previously described. Thus, the container half 103 has an opening 117 through which the ink bag spout 114 extends for the flow of ink from the flexible ink bag 106.

Fountain 76 is directly beneath spout 114, and it has an upwardly facing opening 115 into which the ink drops.

The upper end of the ink bag 106, at seen in FIG. 10, has a tab 118 integral with the bag 106, and the tab is a flat and therefore planar extent of the bag flexible material which can be a heavy duty plastic materials. The tab 118 is therefore connected with the upper end of the bag 106 and extends between the halves 102 and 103 and is trapped therebetween to at least assist in holding the bag 106 in its upright position during operation that is, the upper end of the bag 106 cannot fall downwardly in the container 101 because the tab 118 will hold it upwardly, and that is of course in addition to the pressure applied to the bag 106 by the air bladder 107, as mentioned.

So both the bag 106 and the bladder 107 are of a flexible material so that the bladder 107 can expand under air pressure introduced therein, and that expansion will be applied in a forceful manner onto the flexible ink bag 106 to squeeze the ink bag 106 in its semi-circular canister half 103, and thereby cause the highly viscsous printing ink to flow through the outlet spout 114, as desired.

Figure 12:
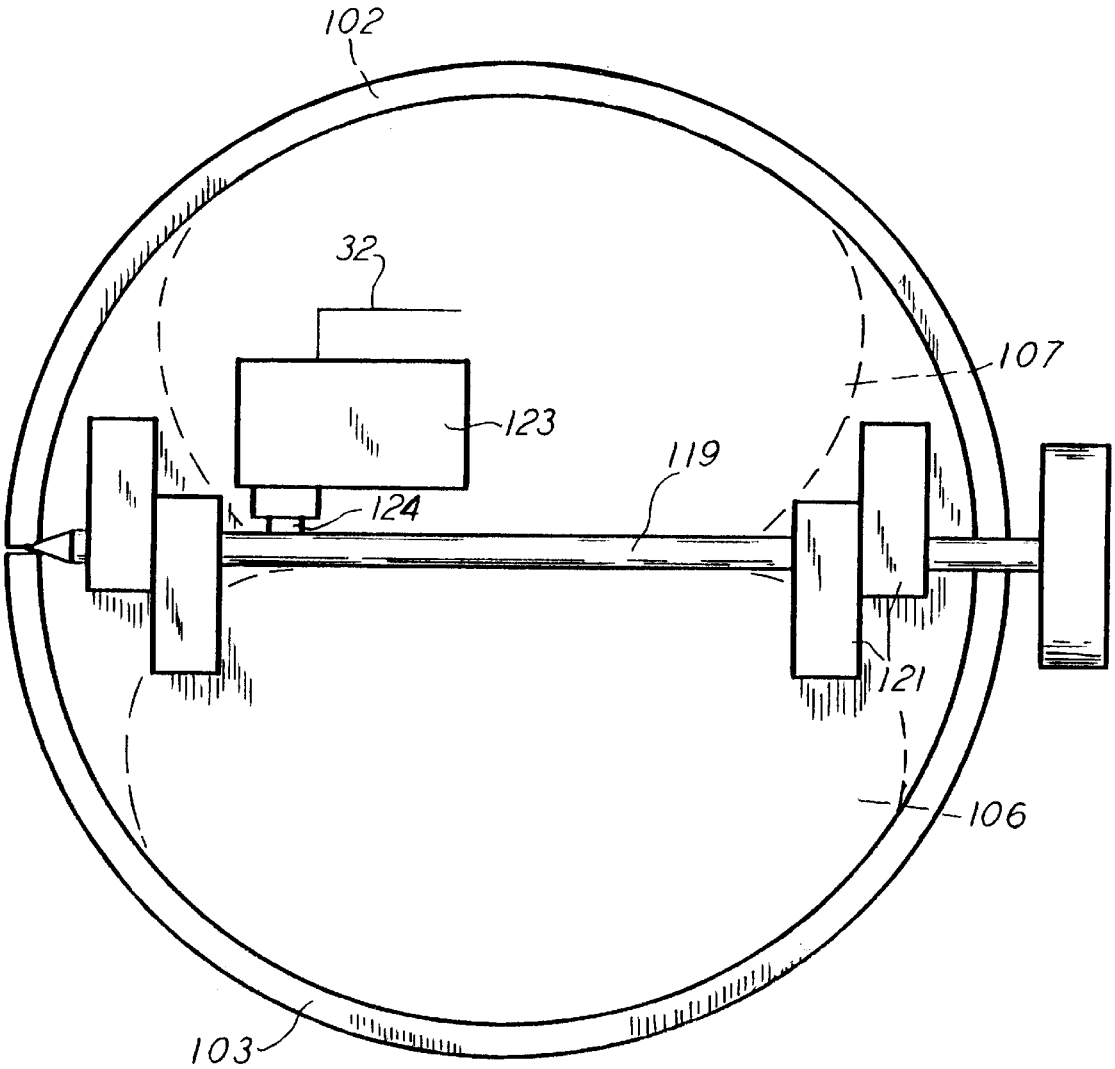
FIGS. 12 and 13 are enlarged top and bottom views, respectively, of FIG. 10.

The drawings, particularly FIG. 12, show when the halves are in the closed position of FIG. 10, a looking pin 119 extends through matching tangs 121 which are respectively affixed to the halves 102 and 103 to align their respective pin holes 122. As such, the pin 119 in extending through the holes 122 on the four tangs 121 holds the canister halves 102 and 103 in the closed and secured position for operation, as seen in FIG. 10.

FIG. 12 also shows that there is an electric safety switch 123 affixed to the container half 102, and it has a movable operation button 124 which engages the pin 119 to thus signal to the air supply that the container 101 is in the closed and ready position for operation. That is, the pin 119 engages the button 124 and depresses it, in the FIG. 12 position, to activate the switch 121 so that air can be suitably supplied to the bladder 107. That arrangement with the switch 123 is a conventional type of connection between the switch 123 and an unshown air supply for the bladder 107, and it may be in the nature of that shown in the previous embodiment.

Figure 13:
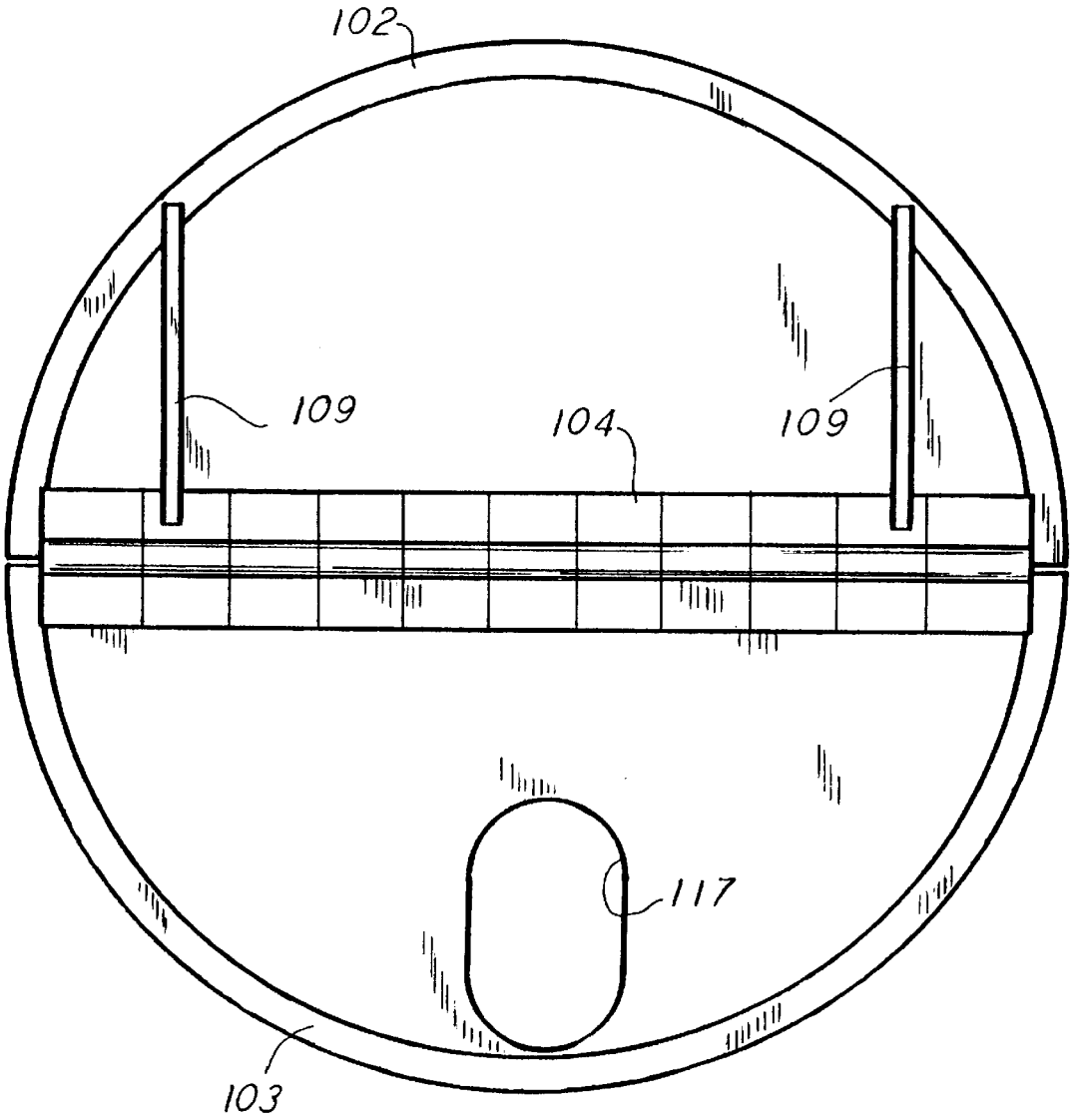

FIG. 13 shows the bottom view where the hinge 104 is seen as a piano-type hinge for pivotally associating the two container halves and for holding them together at the bottom. Also, the container outlet 117 is shown to be elongated oval shape, and, as such, the ink bag spout 114 can be readily moved into the opening 117 when a fresh bag of ink 106 is being inserted in the FIG. 11 condition.

FIG. 14 shows that there is a semi-circular gate plate 126 which is shown snug with the semi-circular wall 127 of the container half 103. The gate 126 has an opening 128 which is smaller than the opening 117, and the gate 126 is conventionally pivotally connected, such as at the pivot post 129, so that it can swing between the operative and closed position of FIG. 14 to the inoperative and loading position of FIG. 15. That is, in the FIG. 15 position, the ink bag 106 can be positioned in the container half 103 and the ink spout 114 can be threaded through the opening 117 without any special attention. Then, the gate 126 can be swung from the FIG. 15 position to the FIG. 14 position and its opening 128 will receive the ink bag spout 114 in a snug manner to control the spout 114 when the bag 106 is subjected to the evacuation pressures and forces inherent in this method and apparatus. Also, the plate 126 could be a free body and simply slid into the FIG. 14 operative position without being pivotally connected to the container, if so desired.

FIG. 16 shows a profile of one ink bag which can have its extreme edges suitably sealed after being filled with ink, and it shows the tab 118 and the outlet spout 114. The bag itself is of a flexible material, such as plastic, and it may be a three-layer nylon material of a linear low density polyethylene. Also, because the printing ink for the press involved with this invention is of a high viscosity, the bag can be positioned in the inverted position shown in FIG. 10 with the spout directed downwardly, and ink will not flow therefrom until the pressure is applied by the bladder 107 and until of course when the spout end 116 is cut or otherwise open.

With this arrangement, the bladder 107 serves as a compressor for the flexible ink bag 106. The bladder 107 can be arranged to have inherently graduated resistance to the internal air pressure and in the graduated direction downwardly all on the bladder 107, as viewed in FIG. 10. That is, there can be elastic bands 131, 132, and 134 completely encircling the somewhat cylindrical bladder 107 and the band 131, being of a minimal height, has less resistance to the expansion of the bladder 107 at that location, as compared to the larger band 132 and the still larger band 134 which offers the greatest resistance to bladder expansion, and thus the bladder expands initially at the upper end adjacent the smaller band 131 to compress the adjacent upper end of the ink bag 106 in the initial application of compressive force on the bag 106, and, sequentially and ultimately, the bladder 107 will expand at its intermediate and lower end to likewise the intermediate and lower ends of the ink bag 106. This assures that the bag 106 will be fully evacuated of its ink, as desired, and from the upper end downwardly and through the spout 114.

It will also be understood that the bladder 107 is of an elastomer material, such as rubber, and it can be made to have the least expansion resistance at its upper end, as viewed in FIG. 10, and graduated increasing resistance toward its lower end.

Further, it reduces the wasting of ink because the entire bag 106 can be efficiently evacuated from top on down through the spout, and there is no ink skinning, and the bags 106 can be quickly changed. Of course the arrangement eliminates the use of the conventional ink cans or cartridges. There is certainly an easy installation of the bag 106, such as indicated in the showing in FIG. 11, and at least up to fifteen pounds of ink can be contained in each ink bag, and that is a substantial amount for a printing press.

The entire system can be automated, such as disclosed in connection with the first embodiment, so that the ink fountain receiving the ink from the bag 106 can be automatically serviced and maintained. Further, the ink bags can be partly used and then removed and resealed for future use. There is a low consumption of power, and the apparatus is not expensive, elaborate, nor is it difficult to operate because it is automated and the operator only needs to load a flexible ink bag into the canister or container 101 and then close the halves and pin them together.

The tab 118 and spout 114 are to one side on the bag 106, so the bag 106 can be pressed against the wall 112 without tearing the tab 118. Similaily, the spout 114 will remain in the hole 117 when the bag is under the force of the bladder 107.

The last-described embodiment has controls connected therewith, as with the other embodiment. Thus, there is the air supply 24 connected with the bladder 107, and there is the control valve 28 in the air supply line. Also, the ink level sensor electric line 32, extending from the sensor 31, is active and suitably connected to the control 28. The entire assembly with the container 101 can be suitably supported and disposed directly over the ink reservoir 76.

The ink bag 106 is always entirely closed, except for its outlet 116, and thus the assembly is not exposed to ink, nor is there any need for clean-up of ink. Of course, a partly used bag of ink can be removed from the canister 101 and sealed and used later, as desired. The cylindrical shape of the canister provides for full compression of the ink bag 106, without having square container corners for the bag to nest in and thereby preclude the removal of all the ink from the bag 106. Of course, the bladder 107 is a compressor which expands under air pressure inside it, and it can expand to completely occupy the entire container 101, and thereby completely press the ink out of the bag 106 which is then flattened against the semi-circular wall 112. Conversely, the bladder 107 can be relieved of the air therein, and then the bladder 107 will collapse into its semi-circular canister 102. In operation, the bladder 107, being shown formed of an endless wall of a flexible elastomer, will conform to whatever shape the ink bag 106 assumes when under pressure from the bladder 106. But neither outside air nor a body contacts the ink.

The bag 106 and the bladder 107 are of a similar shape and over-all external dimensions as shown. They each occupy the respective one-half 102 and 103 of the canister 101, and together they occupy the entire canister 101. The half 102 is stationary in that it can be mounted fixedly relative to a printing press, such as over the reservoir or fountain which supplies ink to the press. The half 103 is movable, as shown by the pivot arrangement for it, and it can then be positioned in the FIG. 11 position for loading a bag of ink into it. The spout 114 would then be positioned in the opening 117, and the gate 126 can be positioned to have its opening 128 confine the spout 114 and preclude the movement of the bag through the opening 117. The tab 118 would be positioned to be clamped between the halves 102 and 103 when the halves are placed in the closed position of FIG. 10.

The bladder 107 can receive fifteen pounds per square inch of air, above atmospheric pressure, and that pressure can exert considerable force onto the flexible ink bag 106, and thereby achieve full evacuation of the ink from inside the bag 106.

Throughout the process, and with this apparatus, the ink is not exposed to air until it is forced from the bag 106. The half 103 has a bottom 136 through which the ink is evacuated.

Flexible means non-rigid therefore unlike metal or card stock, and pliable.

The bag is elongated in the direction of the extent of the spout, and the ink flows from the bag in the direction of that elongation. Also, the force applied by the bladder is at a right angle to the direction of flow and the elongated direction. The bladder, and the bag, will conform to the shape of the container abutment when the bag is emptied of its ink. That is, the bag will be semi-circular in its cross-sectional shape when the ink is dispensed therefrom. Of course, if the abutment were planar, then the emptied bag would also be planar.

The solenoid 28 and the ink level sensor 31 and the conventional electric safety switch 123 are all shown in the electric schematic of FIG. 17, which is showing a standard 120-volt system. Also shown is a conventional electric manual start switch 137 which is connected as shown. Additionally, there is a conventional electric timer 138 suitably electrically connected into the system, as shown. Finally, there is a conventional electric warning light 139 which is suitably electrically connected into the system, as shown. The warning light 139 can be mounted on the canister 101 and out in the open in a position where the printing press operator has full view of the light 139.

The safety interlock switch 123 is of the normally open type, as shown, and it will close only when the latch pin 119 is engaged with the switch 123, as in the FIG. 12 position.

The electric system of FIG. 17 is arranged so that when the ink level sensor is in the closed position shown, it is connected with the timer 138. The timer 138 will of course sense a length of time that the connected level sensor is signaling for the pumping of ink from the ink bag 106. After that length of time when no ink has been pumped, then the timer powers the warning light 139. The operator then opens the canister 101, removes the emptied bag 106, and replaces the bag 106 with another bag 106 which has ink in it. The removed bag 106 will be flatten with is two opposite sides presses together, and it will be of the same length that is had when it was full of fifteen pounds of ink, for instance.

The half 102 presents a confinement for the bladder 107, and has an opening through which the bladder spout 113 is shown to extend. The halves 102 and 103 present opposingly facing walls, such as the wall 112, which respectively restrain the bladder 107 and the bag 106. The valve 28 has its relief 29 to accommodate deflation of the bladder 107 when the system is not forcing on the bag 106.

An annular elastic restrictor 141 surrounds the spout 114 to constrict the spout ink passageway 142 when the bladder force on the bag 106 is stable and not being increased, as seen in FIG. 10. The size and elastic strength of restrictor 141 are such that the spout passageway 142 closes and opens according to the bladder forces, to avoid ink dripping when there is only a minimal bladder force, and the restrictor 141 circularly expands with greater bladder force.

FIG. 10 shows that the bag 106 and the bladder 107 are elongated in the vertical direction shown, and they are of a similar shape and size in initial form. So they both have an upright longitudinal axis disposed parallel to the abutment 112, and the spout 114 is directed, and has its outlet directed, parallel to that upright length of the bag 106, as shown by the arrow below the spout 114, and the spout is offset from that upright central axis of the bag 106, which axis is half way on the bag and to the left of the spout 114. The force from the bladder is thus a compressor force and is directed perpendicular to that longitudinal axis of the bag 106, and that force is then along the entire length of the flexible bag 106, and is as indicated by arrows A.

The full bag 106 is of the size to substantially occupy the canister half 103, volume-to-volume, and likewise with the initially inflated bladder 107, and both conditions are as shown in FIG. 10. In operation, the bladder expands to occupy substantially the entire canister 101, and, in response to only deflation, the bladder contracts to the size shown in FIG. 10 to occupy only its one-half 102 of the canister 101. The bladder therefore does not require that it be forced upon to have it recede to the loading mode, such as seen in FIG. 10.

What is claimed is:

1. A method for dispensing ink to a printing press, comprising the steps of placing ink into a flexible bag which has an outlet spout disposed with an ink flow passageway in position for receiving ink directly thereinto in an outlet flow direction at an end of said bag which has two sides disposed on opposite sides of said spout and parallel to said flow direction, positioning said bag with a first one of said sides disposed parallel to and adjacent an abutment and in ink-flow communication through said spout and to a printing press, positioning an air bladder of an endless wall of elastomer material adjacent said bag at a second one of said sides, inflating said bladder with pressurized air and forcing said wall of said bladder in a direction transverse to said outlet flow direction and into contact with and directly against said second side of said bag and then forcing said bag against said abutment and thereby forcing the ink to flow from said bag in a direction through said spout and to slid printing press, and sensing the amount of ink flowing from said bag and regulating the inflating of said bladder in accord with the amount of flowing ink.

2. The method for dispensing ink to a printing press as claimed in claim 1, including the steps of placing said bag and said bladder into a rigid container to surround said bag and said bladder with said container and with said container including said abutment, and arranging and inflating said bladder to have said bladder force against said bag and said container and thereby have the ink flow from said bag through said spout.

3. The method for dispensing ink to a printing press as claimed in claim 1, including hanging said bag from an end thereof and in the position to be adjacent to said abutment, and applying the force of said bladder onto said bag in a direction only transverse to said direction of the flow of ink through said spout.

4. The method for dispensing ink to a printing press as claimed in claim 1, including suspending said bag in an upright position with said spout in a lowermost position, and forcing on said bag by said bladder in sequence commencing initially at the portion of said bag most distant from said spout.

5. The method for dispensing ink to a printing press as claimed in claim 1, including disposing said bag in an inverted position on an upright plane whereby said spout is in the lowermost position relative to the remainder of said bag, and arranging said spout to be in a position offset to one side of said upright plane and adjacent said first side of said bag, and applying bladder force only in a direction toward said first side.

6. The method for dispensing ink to a printing press as claimed in claim 1, including placing said bag and said bladder into a container which includes said abutment and having said bladder and said bag occupy said container in an arrangement whereby said bladder and said bag are restrained by said container when said bladder is inflated with air.

7. The method for dispensing ink to a printing press as claimed in claim 1, wherein, the forcing of said bladder against said bag is only at a right angle to the direction of the ink moving through said spout.

8. The method for dispensing ink to a printing press as claimed in claim 1, including actuating a control switch in accord with inflating said bladder, whereby said bladder will not be inflated without activation of said switch.

9. The method for dispensing ink to a printing press as claimed in claim 1, including disposing said abutment in an upright plane, suspending said ink bag in said upright plane adjacent said abutment to have said spout at the lowermost location on said ink bag and with said flow direction being directed downwardly, and applying the force exerted by said bladder and on said ink bag only transverse to said plane and initially only at the portion of said ink bag furthest from said spout and then sequentially to said spout.

10. A method for dispensing ink to a printing press, comprising the steps of placing ink into a flexible bag which has an outlet spout defining an ink-flow direction and two sides respectively disposed on opposite sides of said spout and parallel to said ink-flow direction, positioning-said bag with a first one of said sides of said bag disposed adjacent an abutment, positioning said bag with a second one of said sides of said bag in direct contact with adjacent) an air bladder formed of an endless wall of elastomer material, and inflating said bladder with pressurized air and forcing said wall of said-bladder directly against and into face-to-face contact with said second side of said bag and then forcing said bag against said abutment and thereby forcing the ink from said bag through said spout.

11. The method for dispensing ink to a printing press as claimed in claim 10, including suspending said bag in an upright position with said spout in a lowermost position on said bag, and forcing on said bag by said bladder in sequence commencing initially at the portion of said bag most distant from said spout.

12. The method for dispensing ink to a printing press as claimed in claim 10, including disposing said bag in an inverted position whereby said spout is in the lowermost position relative to the remainder of said bag, and arranging said spout to be disposed offset on said bag and thereby adjacent said first side.

13. The method for dispensing ink to a printing press as claimed in claim 10, including placing said bag and said bladder into a canister which includes said abutment and having said bladder and said bag occupy said canister in an arrangement whereby said bladder and said bag are restrained by said canister when said bladder is inflated with air.

14. The method for dispensing ink to a printing press as claimed in claim 10, including suspending said ink bag adjacent said abutment to have said spout at the lowermost location on said ink bag, and applying the force exerted by said bladder and on said second side of said ink bag initially only at the portion of said ink bag furthest from said spout and then sequentially to said spout.

15. The method for dispensing ink to a printing press as claimed in claim 10, including activating a switch for controlling the air supply to said bladder and doing so when said ink bag is in contact with said bladder, and releasing from said bladder the pressurized air therein and allowing the elastomer character of said bladder to cause said bladder to self-deflate and self-contract to a condition of readiness for a subsequent inflation.

16. An ink dispenser for dispensing ink to a printing press comprising, a pliable ink container bag with ink therein and having an ink outlet spout therein and arranged for the flow of ink from said container in a given direction, and an air bladder of an elastomer material and having only an endless wall forming a complete enclosure disposed adjacent said ink container and being air-inflatable and arranged for expanding and forcing said wall into direct contact with said ink container only in a direction perpendicular to said given direction to cause the ink in said container to flow directly into said outlet spout in said given direction.

17. The ink dispenser for dispensing ink to a printing press as claimed in claim 16, wherein said ink container is a pliable bag and said outlet spout extends in a downward direction, and including an uprightly disposed support adjacent said bag on the side of said bag which is opposite from the location of said bladder and said support is disposed parallel to the extent of said downward direction, whereby air-inflation of said bladder expands said bladder into forcing on said bag to evacuate the ink from said bag through said outlet spout.

18. The ink dispenser for dispensing ink to a printing press as claimed in claim 17, wherein said support completely surrounds said bag except in the direction from said bag to said bladder, and thereby the air-inflation of said bladder-forces said bag against said support for squeezing the ink from said bag, and said spout is offset on said bag in the direction perpendicular to the force applied by said bladder onto said bag.

19. The ink dispenser for dispensing ink to a printing press as claimed in claim 16, wherein said bladder and said bag are disposed in side-by-side relationship, and said support being operatively associated with said bag to restrain said bag from movement away from said bladder when said bladder is expanded by being inflated with air.

20. The ink dispenser for dispensing ink to a printing press as claimed in claim 16, wherein said ink container outlet spout extends in said flow direction and offset on said container in-said perpendicular direction, and said ink container has a tab for hanging said ink container in a position with said spout lowermost on said ink container.

21. The ink dispenser for dispensing ink to a printing press as claimed in claim 16, including an air supply control operatively associated with said bladder for supplying air to said bladder, and an ink quantity sensor operatively associated with said air supply control for sensing the quantity of ink dispensed and causing said control to operate to inflate said bladder.

22. An ink dispenser for dispensing ink to a printing press comprising, a pliable ink container with ink therein and having an ink outlet spout with a passageway for ink flow into said passageway in a given direction and having two sides disposed on opposite sides of said spout and respectively extending parallel to said direction, and a compressor disposed adjacent said ink container and being arranged in direct contact with said container to force directly on said container only in a direction perpendicular to said given direction and from one of said sides toward the other of said sides to squeeze the ink from said container through said-outlet spout.

23. The ink dispenser for dispensing ink to a printing press as claimed in claim 22, including an abutment spaced from said compressor, and said ink container being disposed in contact with said abutment in the space between said abutment and said compressor and with said outlet spout being directed exteriorly of said space.

24. An ink dispenser for dispensing ink to a printing press, comprising a rigid canister having an interior with an abutment thereon, an air-inflatable bladder forming a complete enclosure defined by a surrounding endless wall of elastomer material disposed in said interior and with said bladder being expandable in said interior, an air supply connected with said bladder and being arranged for expanding said bladder in a first direction, a flexible bag of ink disposed in said interior between said abutment and said bladder and being in direct contact with said wall and having an ink-flow outlet spout extending downwardly in a second direction perpendicular to said first direction and extending from said interior to outside said canister for the flow of ink, and said bladder and said bag being disposed in side-by-side relationship and with said bladder being arranged for its expansion to force on said bag only in said first direction.

25. The ink dispenser for dispensing ink to a printing press as claimed in claim 24, wherein said flexible bag of ink is disposed with said spout thereof in the lowermost position on said bag, and said canister has an opening therein and said spout extends through said opening to outside said canister.

26. The ink dispenser for dispensing ink to a printing press as claimed in claim 24, including a restrictor engaged with said spout and being arranged for constricting said spout to limit the flow of ink through said spout when air pressure is stabilized in said bladder, and to thereby avoid the dripping of ink from said spout.

27. A method for dispensing ink to a printing press comprising the steps of positioning an air-actuated compressor-in a container, providing a flexible bag of ink with an elongated outlet spout thereon and of an elastomer material, placing said flexible bag of ink adjacent said compressor and with said spout positioned in a downward direction, closing said spout to the flow of ink therethrough when air pressure is not being applied to said compressor, applying a force onto said bag by said compressor to move the ink through said spout, and positioning an elastomer expandable and collapsible collar around said spout and having said collar arranged to expand in response to said force of said compressor moving ink through said spout and having said collar arranged to collapse onto said spout to close said spout when said compressor is not exerting said force on said bag.

28. A method for dispensing ink to a printing press, comprising the steps of placing ink into a flexible bag which has an outlet spout, positioning said bag with a first side of said bag disposed adjacent an abutment and in ink-flow communication through said spout and to a printing press, positioning an air bladder adjacent said bag at a second side of said bag opposite from said first side, inflating said bladder with pressurized air and forcing said bladder against said second side of said bag and then forcing said bag against said abutment and thereby forcing the ink from said bag through said spout and to said printing press, sensing the amount of ink flowing from said bag and regulating the inflating of said bladder in accord with the amount of flowing ink, moving said abutment away from said bladder and then positioning said ink bag adjacent said abutment, and moving said abutment and said ink bag toward said bladder and positioning said ink bag into position to be forced upon by said bladder.

29. A method for dispensing ink to a printing press, comprising the steps of placing ink into a flexible bag which has an outlet spout and a side on each oppositely disposed side of said bag, positioning said bag with a first one of said sides of said bag disposed adjacent an abutment, positioning said bag with a second one of said sides of said bag adjacent an air bladder, inflating said bladder with pressurized air and forcing said bladder against said second side of said bag and then forcing said bag against said abutment and thereby forcing the ink from said bag through said spout, sensing the quantity of ink dispensed to said printing press, activating a control for applying air to said bladder in accord with the sensing of ink dispensed, timing the length of time that said control is activated, and activating a signal after a length of time has transpired for the activation of said control.

30. An ink dispenser for dispensing ink to a printing press comprising, a pliable ink container with ink therein and having an ink outlet opening therein and arranged for the flow of ink in a given direction, an air bladder disposed adjacent said ink container and being air-inflatable and arranged for expanding and forcing on said ink container in a direction perpendicular to said given direction to cause the ink in said container to flow through said outlet spout, said ink container is a pliable bag, a support adjacent said bag on the side of said bag which is opposite from the location of said bladder, whereby air-inflation of said bladder expands said bladder into forcing on said bag to evacuate the ink from said bag through said outlet spout, said support completely surrounds said bag except in the direction from said bag to said bladder, and thereby the air-inflation of said bladder forces said bag against said support for squeezing the ink from said bag, said support is an enclosure having sides extending therearound and being separable into two equal halves, and both said bladder and said bag are disposed in respective halves of said enclosure.

31. An ink dispenser for dispensing ink to a printing press comprising, a pliable ink container with ink therein and having an ink outlet opening therein and arranged for the flow of ink in a given direction, an air bladder disposed adjacent said ink container and being air-inflatable and arranged for expanding and forcing on said ink container in a direction perpendicular to said given direction to cause the ink in said container to flow through said outlet spout, a support having two portions for respectively supporting said ink container and said bladder, and said portion of said support supporting said ink container being movable away from said portion of said support supporting said bladder, for removing and installing said ink container relative to said support.

32. An ink dispenser for dispensing ink to a printing press comprising, a pliable ink container with ink therein and having an ink outlet opening therein and arranged for the flow of ink in a given direction, an air bladder disposed adjacent said ink container and being air-inflatable and arranged for expanding and forcing on said ink container in a direction perpendicular to said given direction to cause the ink in said container to flow through said outlet spout, a canister having a movable portion for access to the interior thereof, said ink container and said air bladder being disposed in side-by-side positions in said canister and being restricted in movement by said canister, and said ink container being movable relative to said canister upon moving said movable portion of said canister for installing and removing said ink container relative to said canister.

33. An ink dispenser for dispensing ink to a printing press comprising, a pliable ink container with ink therein and having an ink outlet spout for ink flow therethrough in a given direction, a compressor disposed adjacent said ink container and being arranged to force on said container in a direction perpendicular to said given direction to squeeze the ink from said container through said outlet spout, an abutment spaced from said compressor, said ink container being disposed in contact with said abutment in the space between said abutment and said compressor and with said outlet spout being directed exteriorly of said space, and a gate movable connected with said abutment and having an opening therein for surrounding said spout and thereby constraining said spout.

34. An ink dispenser for dispensing ink to a printing press, comprising a rigid canister having an interior with an abutment thereon, an air-inflatable bladder disposed in said interior for expansion in said interior, an air supply connected with said bladder and being arranged for expanding said bladder in a first direction, a flexible bag of ink disposed in said interior between said abutment and said bladder and having an ink-flow outlet spout extending downwardly in a second direction perpendicular to said first direction and extending from said interior to outside said canister for the flow of ink, and said canister having two half portions with one of said portions arranged to be movable relative to the other of said portions and with said one portion being pivotally attached to said other portion for moving away from said other portion and thereby expose the interior of said canister for the removal and replacement of said bag relative to the interior of said canister.

35. An ink dispenser for dispensing ink to a printing press, comprising a rigid canister having an interior with an abutment thereon, an air-inflatable bladder disposed in said interior for expansion in said interior, an air supply connected with said bladder and being arranged for expanding said bladder in a first direction, a flexible bag of ink disposed in said interior between said abutment and said bladder and having an ink-flow outlet spout extending downwardly in a second direction perpendicular to said first direction and extending from said interior to outside said canister for the flow of ink, said canister having two half portions with one of said portions arranged to be movable relative to the other of said portions and with said one portion being pivotally attached to said other portion for moving away from said other portion and thereby expose the interior of said canister for the removal and replacement of said bag relative to the interior of said canister, said one portion has an extended surface pivotal to a horizontal position, and a hinge connected between said portions and arranged to permanently connect said portions together and position said surface in a horizontal plane when said one portion is pivoted away from said other portion of said canister, for said bag to be laid onto said surface in the inclusion of said bag in said canister.

36. An ink dispenser for dispensing ink to a printing press, comprising a rigid canister having an interior with an abutment thereon, an air-inflatable bladder disposed in said interior for expansion in said interior, an air supply connected with said bladder and being arranged for expanding said bladder in a first direction, a flexible bag of ink disposed in said interior between said abutment and said bladder and having an ink-flow outlet spout extending downwardly in a second direction perpendicular to said first direction and extending from said interior to outside said canister for the flow of ink, an ink dispensing sensor having an "on" and an "off" position for monitoring the dispensing of ink, an air valve operatively connected with said sensor and said bladder for governing the air passing to and from said bladder, a timer operatively connected with said sensor, and a warning signal operatively connected with said timer and being arranged to be activated after said sensor is in the "on" position for at least a selected length of time.

37. An ink dispenser for dispensing ink to a printing press comprising, a pliable ink container bag with ink therein and having an elastomer outlet spout with a passageway directed downwardly and arranged for the flow of ink from said container and into said passageway and through said spout, a compressor disposed adjacent said ink container bag and being arranged for applying a force onto said ink container bag to cause the ink in said container to flow into said said passageway and through said spout, an elastomer member disposed to surround said spout and being contractible onto said spout to close said passageway when said bladder is not applying said force onto said spout and thus avoid having the ink flow from said bag, and said member being of a flexibility to be free of contraction onto said spout and thus allow the ink to flow through said passageway in response to said force from said compressor.

* * * * *